US005251982A

United States Patent [19]

Stenstrom Lennart A. et al.

[11] Patent Number: 5,251,982

[45] Date of Patent: Oct. 12, 1993

[54] DISCHARGING DEVICE FOR A PACKAGING CONTAINER

[75] Inventors: Stenstrom Lennart A., Trosa; Lennart S. Wahlstrom, Saltsjobeden; Bert S. Wikholm, Tullinge, all of Sweden

[73] Assignee: AB Tetra Pak, Sweden

[21] Appl. No.: 967,555

[22] PCT Filed: Jul. 6, 1989

[86] PCT No.: PCT/SE89/00394

§ 371 Date: Mar. 6, 1991

§ 102(e) Date: Mar. 6, 1991

[87] PCT Pub. No.: WO90/00503

PCT Pub. Date: Jan. 25, 1990

Related U.S. Application Data

[63] Continuation of Ser. No. 623,800, Mar. 6, 1991, abandoned.

[30] Foreign Application Priority Data

Jul. 8, 1988 [SE] Sweden ..... 8802557

[51] Int. Cl.[5] ..... B65D 33/36

[52] U.S. Cl. ..... 383/209; 383/906; 206/438; 604/408

[58] Field of Search ..... 383/209, 208, 207, 906; 206/438, 363, 570; 604/408

[56] References Cited

U.S. PATENT DOCUMENTS

| | | | |
|---|---|---|---|
| 2,499,528 | 3/1950 | Reitzes | 383/209 X |
| 2,541,674 | 2/1951 | Snyder | 383/209 |
| 2,999,627 | 9/1961 | Reinhardt | 383/906 X |
| 3,083,876 | 4/1963 | Schneider et al. | 383/209 X |
| 3,171,581 | 3/1965 | Kugler | 383/209 X |
| 3,224,640 | 12/1965 | Schneider et al. | 383/209 X |
| 3,390,507 | 7/1968 | Repko | 383/209 X |
| 3,473,703 | 10/1969 | Lippincott | 383/906 X |
| 3,474,789 | 10/1969 | Soto | 383/200 X |
| 4,119,128 | 10/1978 | Bishop | 383/109 X |
| 4,240,481 | 12/1980 | Bayham | 383/209 X |
| 4,439,192 | 3/1984 | Leurink | 383/209 X |
| 4,484,904 | 11/1984 | Fowler | 604/408 X |

FOREIGN PATENT DOCUMENTS

| | | | |
|---|---|---|---|
| 0368145 | 5/1990 | European Pat. Off. | 383/906 |
| 2573391 | 5/1986 | France | 383/906 |
| 8904280 | 5/1989 | World Int. Prop. O. | 604/408 |

*Primary Examiner*—Allan N. Shoap
*Assistant Examiner*—Jes F. Pascua
*Attorney, Agent, or Firm*—Lerner, David, Littenberg, Krumholz & Mentlik

[57] ABSTRACT

A packaging container having a discharging or docketing device for allowing uninterrupted aseptic connection to for instance a hose having an orfice The container has a channel (13') of a flexible material terminated by a grip flap (16). The flap (16) is torn away along tearing denotations (17, 17') and weakenings (19, 20) for opening the channel. By locating the weakenings (16) such that they do not coincide there is obtained at least one protruding portion which will expose portion on the inside of the channel when the channel is opened up.

This portion then acts as an entering surface for facilitating connection.

4 Claims, 4 Drawing Sheets

DISCHARGING DEVICE FOR A PACKAGING CONTAINER

This is a continuation of application Ser. No. 07/623,800, filed Mar. 6, 1991, now abandoned.

FIELD OF THE INVENTION

The present invention relates to a discharging device for a packaging container and more precisely to a discharging device of the docking type. The connection or docking of a packaging container to for instance a hose having an orfice frequently represents a need. Within the medical care, there are consumed a huge amount of poaches of flexible material for nutrition solutions of different types and there is a need for handling such packages in a more rational manner.

Besides, there is a high degree of aseptics necessary when parental nutrition solutions are involved, for instance infusion solutions, etc.

Prior art and background of the invention: The prior art within the field of discharging devices for flexible poaches comprises poaches having specific orfices welded to the poach before filling and sealing, said orfices having tearable closures or needles or other puncturing tools for penetrating a membrane of the closure.

The prior art discharging or docking devices do meet reasonable hygiene and aseptic standards but from a production point of view the known constructions imply higher cost due to an irrational manufacturing procedure needing for instance separate welding of orfice details.

Previously, poaches of the actual type have been manufactured in the traditional manner, i.e. poaches have been manufactured individually from blanks.

The use of a "hose" technic for manufacturing poaches having an aseptic contents is for instance enclosed in Swedish Patent No. 455,044. Such technics, however, makes use of a separate connector member for docking to the interior of the poach.

OBJECTS OF THE INVENTION

The object of the present invention is to provide a packaging container having an integral docking device or discharging device, for instance formed directly from a hose forming procedure, and allowing an aseptic type of docking or assembling to a discharge conduit. The docking device according to the present invention may, with advantage, be used in an application where a product containing package is formed from a filled hose, but of course there are other fields of application.

SUMMARY OF THE INVENTION

Thus, the invention provides a packaging container having a channel formed of a flexible material intended for connecting the interior of the container to a discharging device, for instance a hose having an orfice.

The container is characterized in that the channel is terminated by a grip flap for opening the channel, and the grip flap is such that it exposes a portion of the inside of the channel when opening up the channel.

In a preferred embodiment there is arranged a denotation for initially tearing off the grip flap at the edge region of the channel, said tearing denotation joining a circumferential weakening line cross-wise the channel, and the circumferential denotation defining at least a section projecting from the opened up channel and acting as an entering surface for the discharging device.

In a specific embodiment the channel is terminated by a weakened welding portion and free grip flaps are arranged outside said welded portion.

In still an embodiment the grip flap is arranged as a termination of a tearable end portion of a channel having a curved cross-section.

DESCRIPTION OF PREFERRED EMBODIMENTS

Figure 1:
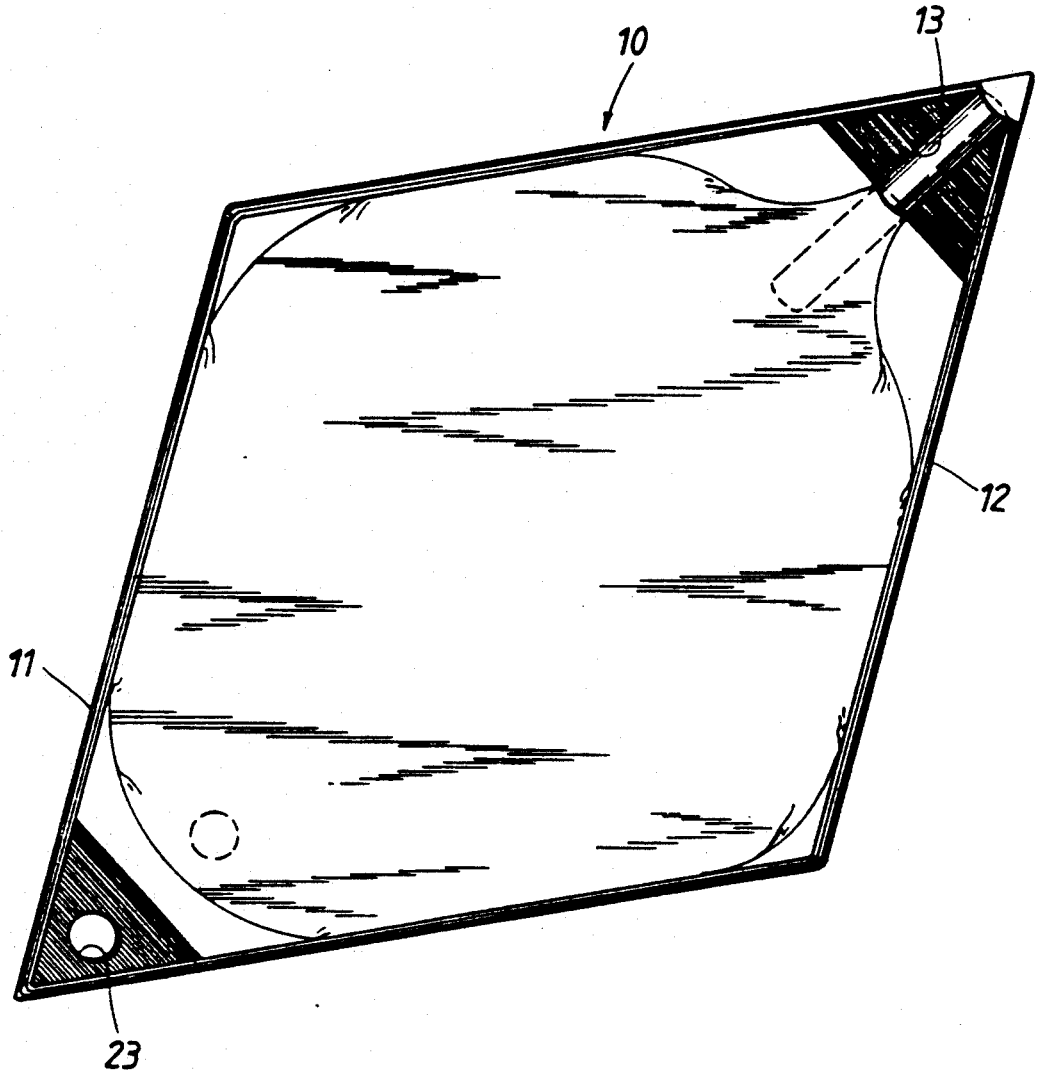
FIG. 1 shows a certain type of flexible poach having a tearing arrangement according to the invention.

The poach 10 in FIG. 1 is a two-sided, alternatively three-sided welded poach. In the first case, there are lateral welds 11, 12 obtained by folding one single planar blank of a flexible plastics or laminate material to the shape in FIG. 1 or by flattening a hose along the regions of the lateral welds 11, 12. In the latter case, the welds 11, 12 preferably are made in a hose filled by a product, meaning that said product, in a manner now per se, is pressed away from the locations for the welds before such welds are made.

At the same time as the welds are made, welds are also made for forming a channel 13 at the corner region of the rhomboidic, filled poach 10 in FIG. 1. Additionally, a weld is made at a diagonally opposite corner for forming a suspension hole 23.

Figure 2:
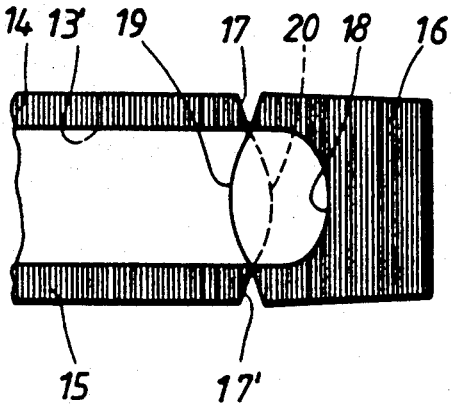
FIG. 2 is a partial view of a first embodiment of a channel having a grip flap.
Figure 3:
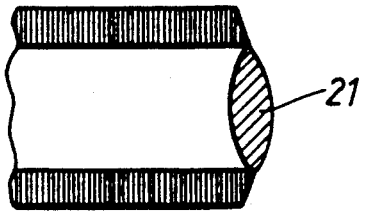
FIG. 3 shows the channel in FIG. 2 exposed after the removal of the grip flap.

In FIG. 2 there is shown in a partial view, in a first embodiment a channel 13', defining two parallel welds 14, 15 and terminated by a grip flap 16. A pair of denotations 17, 17' for initial tearing off the grip flap are arranged in a respective one of the welds 14, 15 The channel 13', which in the actual case may be formed by two plastics toils, laminates or webs, is terminated in an unopened condition along the curved line 18 in FIG. 2. Outside such line the grip flap is welded as indicated by the hatched areas. In the upper web in FIG. 2 forming the channel 13' there is a first curved weakening 19, and in the lower web in FIG. 2 there is a second curved weakening 20 shown hatched. As appears from FIG. 2 and as more precisely shown in FIG. 3, there will be obtained a docking or entering portion 21 of the channel after tearing off the grip flap along the weakenings 19, 20. This portion 21 exposes part of the inside of the channel directly after tearing and allows a quick insertion of the orfice of the discharge device. The aseptics will be interrupted only shortly and the contents of the inner packaging container will not be disturbed at all by an entering or docking operation.

Figure 4:
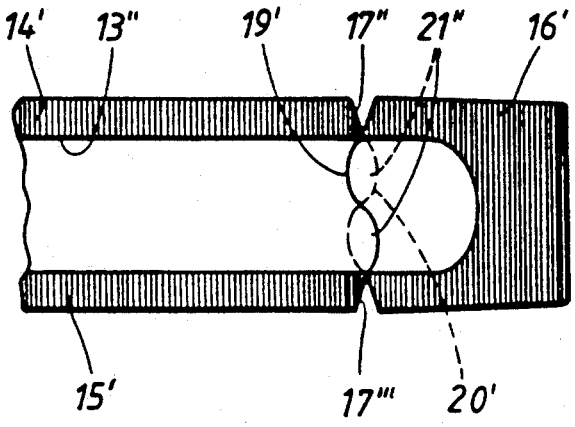
FIG. 4 shows another embodiment of a channel having a grip flap.

In FIG. 4 it is shown how there is obtained more than one entering surface. Also here, the channel 13'' is terminated by a grip 16'. In welds 14', 15' there are initial denotations 17'', 17''' and in the upper foil web there is a S-shaped weakening 19', and in a corresponding manner as in FIG. 2, there is weakening 20', in this case S-shaped in the lower foil web.

Figure 5:
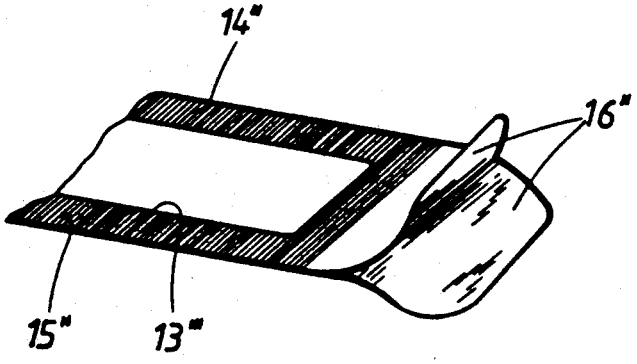
FIG. 5 shows still one more embodiment of a channel and a grip flap.
Figure 6:
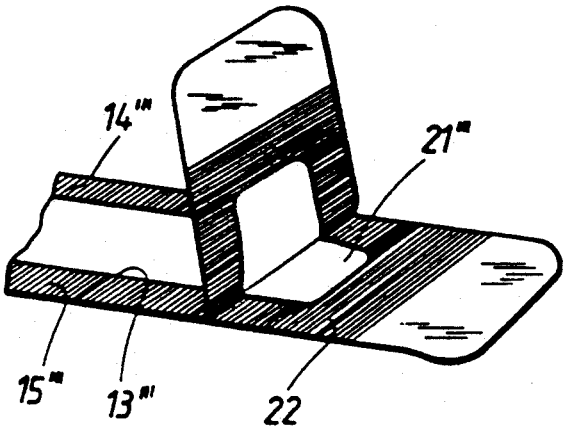
FIG. 6 shows the channel in FIG. 5 opened up.

In FIG. 5 the grip has a pair of free flaps 16''. The channel 13''' is defined by two parallel welds 14'', 15'' and is terminated by a weakened transverse weld 22. This weld 22 may be formed as a so called peelable weld by means of prior art technics. The entering surface obtained for the aseptic docking has been denoted 21''' in FIG. 6.

Figure 7:
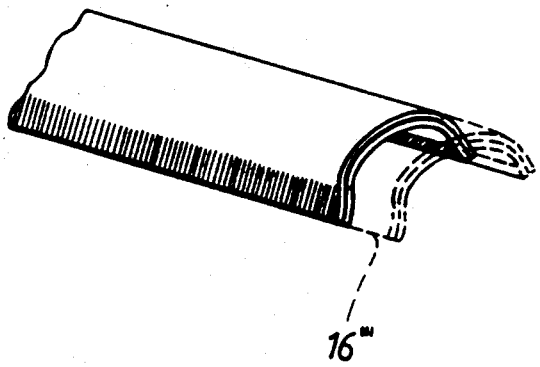
FIG. 7 shows one version of a channel having an accompanying grip.
Figure 8:
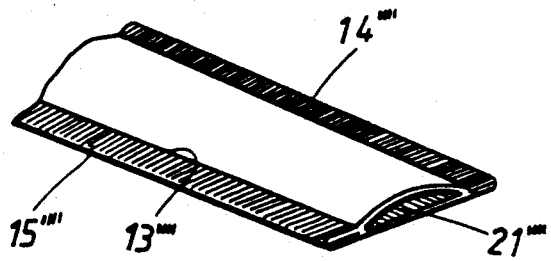
FIG. 8 shows the channel in FIG. 7 opened up and exposed.

In FIG. 7, 8 there is a channel 13'''' defined by two parallel welds 14'''', 15''''. The two foils which form a channel in FIG. 7, 8 have been welded together as appears from FIG. 7, i.e. having a curved cross section, contrary to the prior "planar" cross-section. The grip portion 16''' in FIG. 7 is removed by means of tearing denotations and weakenings and as a result the configuration according to FIG. 8 is obtained. The entering surface has been denoted 21''''.

Although a few embodiments of the invention have been described, it is realized that modifications and alternatives are possible within the scoop of the inventive idea. For instance, which is common, the channels 13–13'' may be formed with decreasing cross-section in a direction towards the interior of the packaging container. Instead of having a flexible poach 10 having an interal channel, it is possible to form separate channel units for mounting to containers of different kinds. However, the integral manufacturing procedure according to the present embodiments is preferable in the present context.

We claim:

1. A dispensing package comprising a reservoir means for storing a flowable material and a dispensing means extending from said reservoir means to a free end for dispensing said flowable material from said reservoir means, said dispensing means including first and second confronting flexible panels sealed together along a pair of spaced edges to define a hollow channel between said confronting panels, said first panel including a first weakening extending arcuately from a first point on said first edge to a second point on said second edge, said second confronting panel having a second weakening extending arcuately from said first point on said first edge to said second point on said second edge, said first and second weakenings together defining a grip flap at said free end of said dispensing means, said first arcuate weakening being disposed further from said reservoir means than said second arcuate weakening such that, upon removal of said grip flap, an access opening is created at said free end of said dispensing means, wherein a portion of an inner wall of said channel defined by an inner surface of one of said confronting flexible panels protrudes from said access opening so as to act as an entering surface for a discharging device.

2. The dispensing package of claim 1, wherein each point on said first weakening and each point on said second weakening are disposed at equal but opposite distances from an imaginary line drawn between said first point on said first edge and said second point on said second edge.

3. A dispensing package comprising a reservoir means for storing a flowable material and a dispensing means extending from said reservoir means to a free end for dispensing said flowable material from said reservoir means, said dispensing means including first and second confronting flexible panels sealed together along a pair of spaced edges to define a hollow channel between said confronting panels, said first panel including a first weakening extending curvilinearly from a first point on said first edge to a second point on said second edge, said second confronting panel including a second weakening extending curvilinearly from said first point on said first edge to said second point on said second edge, said weakenings together defining a grip flap at said free end of said dispensing means, at least a portion of said first curvilinear weakening being disposed further from said reservoir than an opposite and corresponding portion of said second curvilinear weakening such that, upon removal of said grip flap, an access opening is created at said free end of said dispensing means, wherein a portion of an inner wall of said channel defined by an inner surface of one of said confronting flexible panels protrudes from said access opening so as to act as an entering surface for a discharging device.

4. The dispensing package of claim 3, wherein each point on said first weakening is at a predetermined distance from said reservoir and each corresponding point on said second weakening is at a corresponding predetermined distance from said reservoir and said points on said weakenings are disposed at equal but opposite distances from an imaginary line drawn between said first point on said first edge and said second point on said second edge.

* * * * *

UNITED STATES PATENT AND TRADEMARK OFFICE

CERTIFICATE OF CORRECTION

PATENT NO. : 5,251,982

DATED : October 12, 1993

INVENTOR(S) : Stenstrom Lennart A. et al

It is certified that error appears in the above-indentified patent and that said Letters Patent is hereby corrected as shown below:

In the Abstract, line 3, "orfice" should read --orifice--.
In the Abstract, line 8, "(16)" should read --(19, 20)--.
In the Abstract, line 8, after "orifice", insert --.--.
Column 1, line 15, "poaches" should read --pouches--.
Column 1, line 23, both occurrences of "poaches" should read --pouches--.
Column 1, line 24, "poach" should read --pouch--.
Column 1, line 34, "poaches" should read --pouches--.
Column 1, line 35, "poaches" should read --pouches--.
Column 1, line 37, "poaches" should read --pouches--.
Column 1, line 41, "poach" should read --pouch--.
Column 1, line 59, "orfice" should read --orifice--.
Column 2, line 6, "an" should read --another--.
Column 2, line 11, "poach" should read --pouch--.
Column 2, line 29, "poach" should read --pouch--.
Column 2, line 30, "poach" should read --pouch--.
Column 2, line 41, "poach" sholud read --pouch--.
Column 2, line 48, after "15", insert --.--.
Column 3, line 23, "scoop" should read --scope--.
Column 3, line 27, "poach" should read --pouch--.
Column 3, line 28, "interal" should read --internal--.

Signed and Sealed this

Twelfth Day of April, 1994

*Attest:*

Bruce Lehman

BRUCE LEHMAN

*Attesting Officer*

*Commissioner of Patents and Trademarks*